United States Patent [19]

Ellis

[11] Patent Number: 5,048,571

[45] Date of Patent: Sep. 17, 1991

[54] PROTECTIVE COVER FOR END YOKE

[75] Inventor: John A. Ellis, Pottstown, Pa.

[73] Assignee: Dana Corporation, Toledo, Ohio

[21] Appl. No.: 441,170

[22] Filed: Nov. 27, 1989

[51] Int. Cl.[5] ..... F16L 57/00; B65D 85/06

[52] U.S. Cl. ..... 138/96 R; 138/89; 138/110; 206/303; 206/69; 206/318; 206/446

[58] Field of Search ..... 138/89, 96 R, 96 T, 138/109, 178, 110, 37; 206/303, 304, 69, 446, 318; 150/54 A; 464/185; 411/352, 371, 372, 373, 374, 375, 376, 377, 520, 521, 525, 526, 528

[56] References Cited

U.S. PATENT DOCUMENTS

| | | | |
|---|---|---|---|
| 622,376 | 4/1889 | Lieber | 138/96 R |
| 1,749,162 | 3/1930 | Scott . | |
| 2,092,535 | 9/1937 | Schnorr | 138/96 T |
| 2,195,530 | 4/1940 | Curtis . | |
| 2,272,863 | 2/1942 | Young | 138/37 |
| 2,365,888 | 12/1944 | Linderfelt et al. . | |
| 3,354,742 | 11/1967 | Tschanz et al. | 138/109 |
| 3,773,169 | 11/1973 | Zahuranec et al. . | |
| 3,856,050 | 12/1974 | Rooney . | |
| 3,942,681 | 3/1976 | Richardson . | |
| 4,013,099 | 3/1977 | Gerigk et al. . | |
| 4,014,368 | 3/1977 | Nelson . | |
| 4,202,378 | 5/1980 | Bush et al. | 138/96 T |
| 4,423,753 | 1/1984 | Smith et al. . | |
| 4,518,017 | 5/1985 | Hennon et al. . | |
| 4,694,863 | 9/1987 | Klopp . | |

*Primary Examiner*—James E. Bryant, III

*Attorney, Agent, or Firm*—MacMillan, Sobanski & Todd

[57] ABSTRACT

A protective cover which is releasably securable to a component having an aperture formed therethrough, such as an end yoke, is disclosed. The cover includes a generally flat circular end portion having a depending skirt portion formed about the outer periphery thereof. The skirt portion is formed integrally with the end portion and extends axially downwardly therefrom to define a hollow cylindrical protected region. First and second legs are formed integrally with the end portion and extend downwardly within and beyond the skirt portion. As they extend from the end portion, the legs diverge slightly apart from one another in inverted-V fashion. At the lower ends of the legs, respective series of shoulders are formed. The cover is installed by slightly compressing the legs together and inserting them through the aperture at one end of the component. When the ends of the legs are moved beyond the opposite end of the component, the legs spring apart such that the shoulders engage the other end to retain the cover thereon.

2 Claims, 2 Drawing Sheets

PROTECTIVE COVER FOR END YOKE

BACKGROUND OF THE INVENTION

This invention relates in general to protective devices and in particular to a protective cover which is releasably securable to an end yoke.

In the vehicle manufacturing industry, it is common for components to be manufactured in one location, then transported to another location for assembly with other components. One component which is often transported between manufacturing and assembly locations is an end yoke. The end yoke has a splined bore formed through a hub portion which permits it to be mounted on a splined shaft for rotation therewith. Typically, the end yoke is mounted on the output shaft of a vehicle transmission. The end yoke further has a pair of spaced apart arms which form a portion of a universal joint. The universal joint provides a variable angular driving connection between the output shaft and a drive shaft. The outer surface of the hub portion of the end yoke is usually formed having a precisely ground outer surface for engagement by a seal.

It is well known that components of this type are not handled carefully during transportation between the manufacturing and assembly locations. As a result, an end yoke frequently receives impacts during such transportation. Consequently, the precisely ground outer surface of the end yoke must be protectively covered in order to prevent damage thereto. Many devices are known in the art for protectively covering components such as this, but several drawbacks to these devices have been noted. Some of these known devices are difficult to install and remove, thereby decreasing their efficiency of use. Others are more easily installed and removed, but have been prone to accidental removal during shipment. Lastly, many of such devices are relatively expensive to manufacture and difficult to use. Thus, it would be desirable to provide a protective cover for a component such as an end yoke which is simple and inexpensive in construction and operation, yet which is reliable.

SUMMARY OF THE INVENTION

This invention relates to a protective cover which is releasably securable to a component having an aperture formed therethrough, such as an end yoke. The cover includes a generally flat circular end portion having a depending skirt portion formed about the outer periphery thereof. The skirt portion is formed integrally with the end portion and extends axially downwardly therefrom to define a hollow cylindrical protected region. First and second legs are formed integrally with the end portion and extend downwardly within and beyond the skirt portion. As they extend from the end portion, the legs diverge slightly apart from one another in inverted-V fashion. At the lower ends of the legs, respective series of shoulders are formed. The cover is installed by slightly compressing the legs together and inserting them through the aperture at one end of the component. When the ends of the legs are moved beyond the opposite end of the component, the legs spring apart such that the shoulders engage the other end to retain the cover thereon.

It is an object of this invention to provide a protective cover for an end yoke which is simple and inexpensive in construction and operation, yet which is reliable.

Other objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
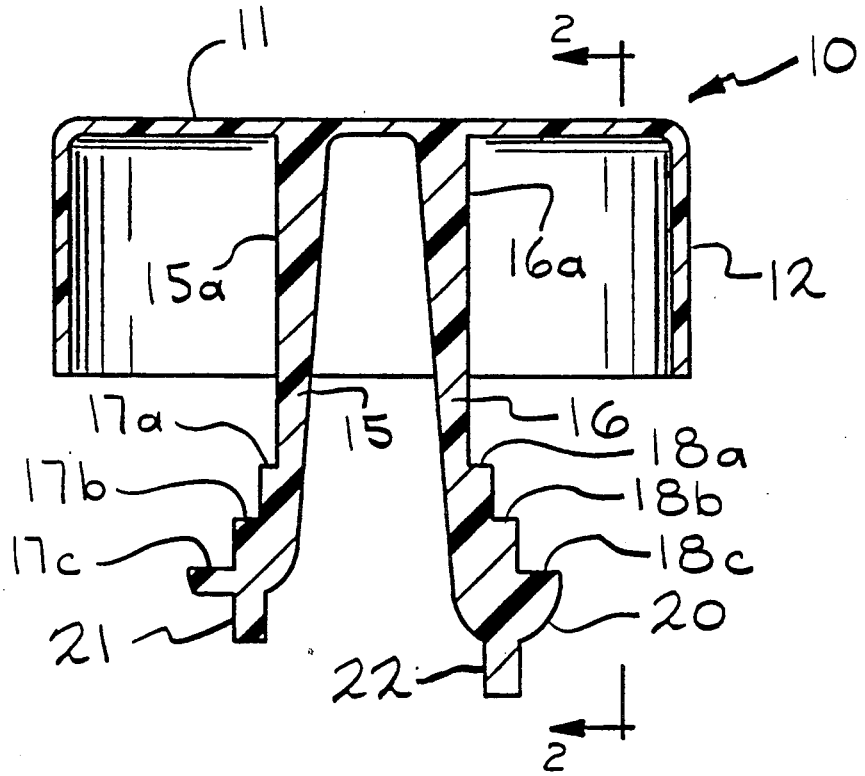
FIG. 1 is a sectional elevational view of a protective cover for an end yoke in accordance with this invention.
Figure 2:
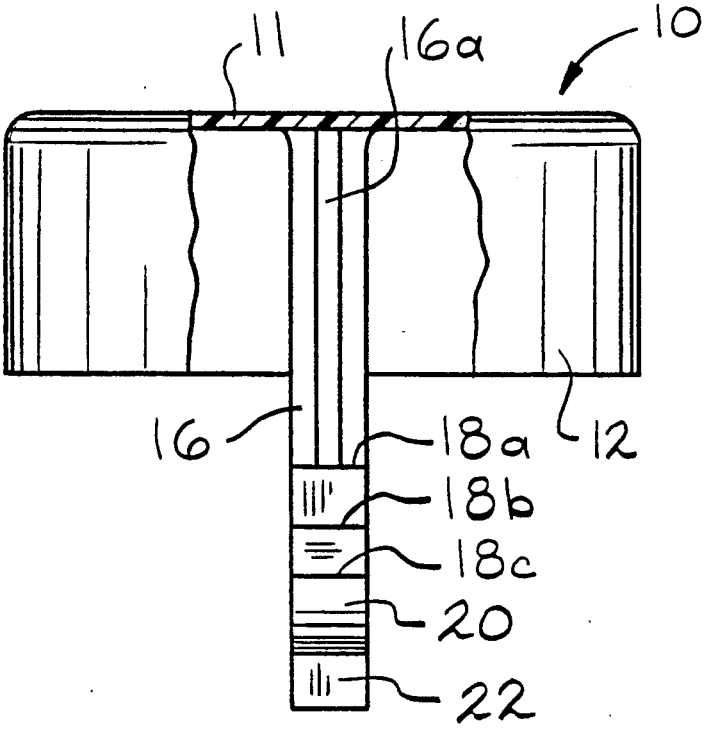
FIG. 2 is a sectional elevational view, partially broken away,. taken along line 2—2 of FIG. 1.

Referring now to the drawings, there is illustrated in FIGS. 1 and 2 a protective cover, indicated generally at 10, in accordance with this invention. The cover 10 includes a generally flat circular end portion 11 having a depending skirt portion 12 formed about the outer periphery thereof. The skirt portion 12 is formed integrally with the end portion 11 and extends axially downwardly therefrom to define a hollow cylindrical protected region, as will be explained below.

First and second legs 15 and 16 are formed integrally with the end portion 11. The legs 15 and 16 are located on opposite sides of a central axis passing through the end portion 11 and are equidistantly spaced therefrom. From the end portion 11, the legs 15 and 16 extend downwardly within and beyond the skirt portion 12. As they extend downward, the legs 15 and 16 diverge slightly apart from one another in inverted-V fashion. Thus, the lower ends of the legs 15 and 16 are spaced apart greater than the upper ends. As best shown in FIG. 2, respective strengthening ribs 15*a* and 16*a* are formed throughout most of the length of the legs 15 and 16.

Near the lower end of the first leg 15, a series of shoulders 17*a*, 17*b*, and 17*c* are formed on an outwardly facing side thereof. A similar series of shoulders 18*a*, 18*b*, and 18*c* are formed on an outwardly facing side of the second leg 16 near the lower end thereof. The shoulders 17*a*, 17*b*, and 17*c* and the shoulders 18*a*, 18*b*, and 18*c* face in opposite directions. The shoulders 17*a*, 17*b*, and 17*c* define increasing axial distances from the end portion 11. The shoulders 18*a*, 18*b*, and 18*c* also define increasing axial distances from the end portion 11, which are equal to the respective axial distances defined by the shoulders 17*a*, 17*b*, and 17*c* . Because of the divergence of the legs 15 and 16, the transverse distance separating the first shoulders 17*a* and 18*a* is less than the transverse distance separating the second shoulders 17*b* and 18*b*. Likewise, the transverse distance separating the second shoulders 17*b* and 18*b* is less than the transverse distance separating the third shoulders 17*c* and 18*c*.

As best shown in FIG. 1, the second leg 16 is formed somewhat longer than the first leg 15. Below the third shoulder 18*c* on the second leg 16, a curved surface 20 is formed. The extended length of the second leg 16 and the curved surface 20 are provided to facilitate the installation of the cover 10, as will be described below. Axially extending tabs 21 and 22 are formed on the lower ends of the first and second legs 15 and 16, respectively. The tabs 21 and 22 are provided to facilitate the removal of the cover 10, as will also be described below.

The entire cover 10 is preferably formed from a relatively stiff, yet slightly flexible material. High density polyethylene has been found to function satisfactorily. However, it will be appreciated that other materials may be used to form the cover 10.

Figure 3:
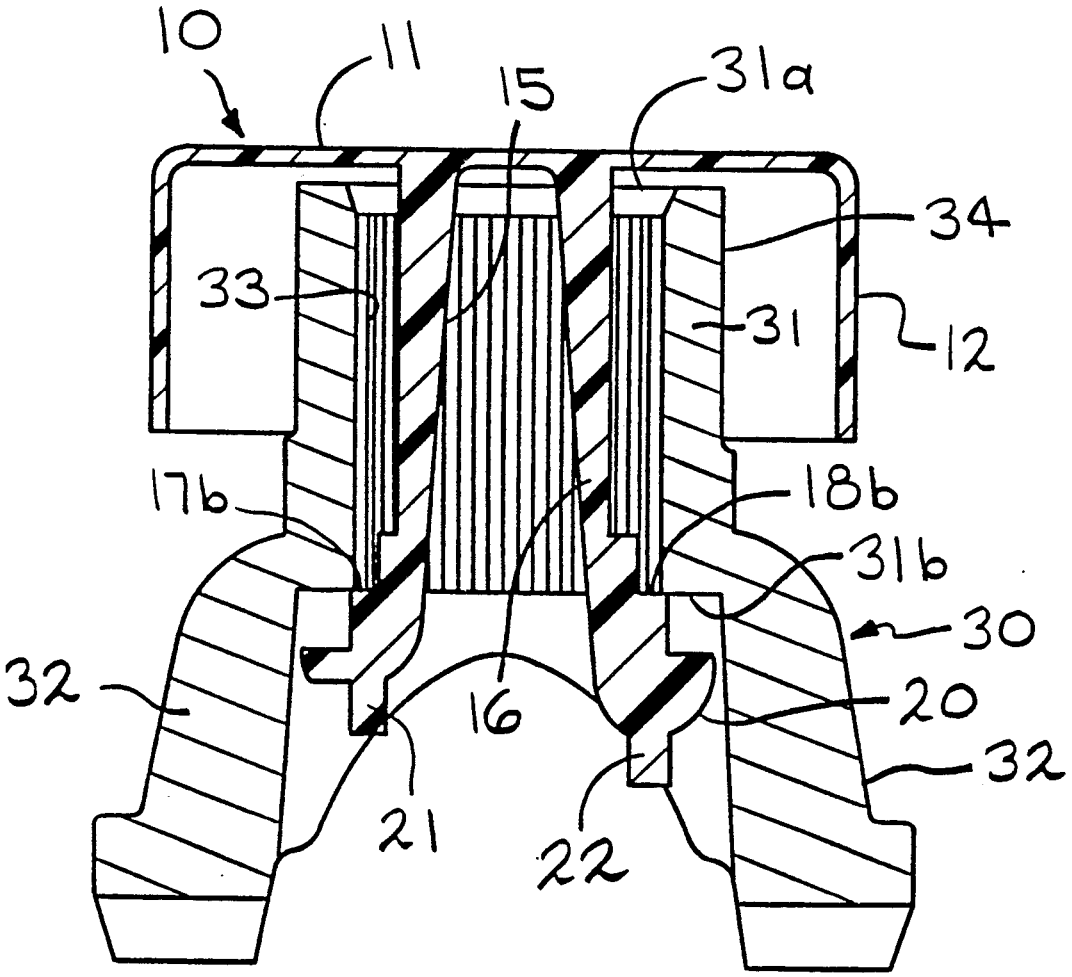
FIG. 3 is a sectional elevational view of the protective cover illustrated in FIG. 1 mounted on a conventional end yoke.

FIG. 3 illustrates the protective cover 10 mounted on an end yoke, illustrated generally at 30. The end yoke 30 is conventional in the art and includes a generally cylindrical hub portion 31 having a pair of space apart arms 32 extending therefrom. A splined bore 33 is formed through the hub portion 31 extending between two end surfaces 31*a* and 31*b* thereof. The splined bore 33 permits the end yoke 30 to be mounted on a male splined shaft (not shown) for rotation therewith. An outer cylindrical surface 34 of the hub 30 is precisely ground to a smooth finish. This precisely ground outer surface 34 is the portion of the end yoke 30 which must be protected from impacts during shipment.

To install the cover 10 on the end yoke 30, the legs 15 and 16 are generally aligned with the splined bore 33 adjacent to the first end 31*a* of the hub portion 31. The inner diameter of the splined bore 33 is slightly smaller than the distance separating the outer sides of the legs 15 and 16. Therefore, the two legs 15 and 16 must be slightly compressed together to permit them to be inserted within the splined bore 33. To facilitate this insertion, the cover 10 is first slightly angled relative to the end yoke 30 Then, the cover 10 is moved axially such that the longer second leg 16 initially enters the splined bore 33, followed by the first leg 15. By angling the cover 10 in this manner, and further by forming the second leg 16 slightly longer than the first leg 15, the legs 15 and 16 may be inserted within the splined bore 33 without exerting a large amount of force to compress them together. Consequently, the amount of force required to begin this installation process is significantly reduced.

As the cover 10 is further moved axially relative to the end yoke 30 in this angled orientation, the lower ends of the legs 15 and 16 slide along the splined bore 33. On the second leg 16, only a small portion of the curved surface 20 engages the splined bore 33. Thus, the surface area of engagement between the second leg 16 and the splined bore 33 is relatively small. As a result, the amount of friction which is generated in opposition to such axial movement is greatly reduced. Such axial movement continues until the lower end of the second leg 16 is moved outwardly from the second end 31*b* of the hub 31. At that point, the second leg 16 snaps outwardly away from the first leg 15. Further axial movement causes the lower end of the first leg 15 to be moved outwardly from the second end 31*b*, where it also snaps outwardly away from the second leg 16. When this occurs, the shoulders 17 and 18 engage the end surface 31*b* of the hub 31. Therefore, the cover 10 is reliably secured to the end yoke 30. In this position, the skirt portion 12 extends over and protectively encloses the precisely ground cylindrical outer surface 34.

It will be appreciated that the cover 10 is easily adapted for use with differently sized end yokes 30. The axial length of the splined bore 33 will determine which of the shoulder pairs 17*a*, 18*a* or 17*b*, 18*b*, or 17*c* , 18*c* will engage the second end 31*b* of the hub 31. The axial movement of the cover 10 is continued until the appropriate pair of shoulders 17*a*, 18*a* or 17*b*, 18*b* or 17*c* , 18*c* automatically seats against the second end 31*b* of the hub 31. As mentioned above, the tabs 21 and 22 are provided to facilitate removal of the cover 10 from the hub 30.

To remove the cover 10, the tabs 21 and 22 are initially squeezed between the thumb and index finger of an operator As a result, the legs 15 and 16 are compressed toward one another. This movement disengages the legs from the second end surface 31*b* of the hub 31, permitting the cover 10 to be moved axially in the opposite direction for removal.

In accordance with the provisions of the patent statutes, the principle and mode of operation of this invention have been explained in its preferred embodiment. However, it must be understood that this invention may be practiced otherwise than as specifically explained and illustrated without departing from its spirit or scope.

What is claimed is:

1. A protective cover adapted to be secured to a component comprising;
   - an end portion;
   - a skirt portion formed about the outer periphery of said end portion;
   - a pair of legs connected to said end portion and extending therefrom within said skirt portion, one of said legs terminating in a rounded surface to facilitate installation of the cover on the component, each of said legs including a plurality of shoulders formed thereon adapted to engage the component, each of said legs further including a depending tab formed thereon to facilitate removal of the cover form the component.

2. The invention defined in claim 1 wherein said legs diverge apart from one another as said legs extend from said end portion.

* * * * *